US009501026B2

(12) United States Patent
Hagimoto et al.

(10) Patent No.: US 9,501,026 B2
(45) Date of Patent: Nov. 22, 2016

(54) IMAGE FORMING APPARATUS

(71) Applicant: Konica Minolta, Inc., Toyota (JP)

(72) Inventors: Noritoshi Hagimoto, Toyohashi (JP); Yoshiki Nakane, Toyokawa (JP); Eri Yoshida, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/047,240

(22) Filed: Feb. 18, 2016

(65) Prior Publication Data

US 2016/0252869 A1 Sep. 1, 2016

(30) Foreign Application Priority Data

Feb. 27, 2015 (JP) ..... 2015-038554

(51) Int. Cl.
*G03G 21/00* (2006.01)

(52) U.S. Cl.
CPC ..... *G03G 21/0011* (2013.01)

(58) Field of Classification Search
USPC ..... 399/107, 110, 123, 343, 350, 351; 15/256.5, 256.51, 256.52
See application file for complete search history.

(56) References Cited

U.S. PATENT DOCUMENTS 7,022,450 B2 * 4/2006 Asano ..... G03G 5/005 399/346
2014/0321880 A1 * 10/2014 Karashima ..... G03G 21/0017 399/101

FOREIGN PATENT DOCUMENTS

| | | | |
|---|---|---|---|
| JP | S63108372 | A | 5/1988 |
| JP | 2003149847 | A | 5/2003 |
| JP | 2007034147 | A | 2/2007 |
| JP | 2011095297 | A | 5/2011 |

* cited by examiner

*Primary Examiner* — Hoan Tran
(74) *Attorney, Agent, or Firm* — Lucas & Mercanti, LLP

(57) ABSTRACT

An image forming device including a photoreceptor with a protective layer, a contact charger; and a metal cleaning blade, wherein the cleaning blade includes a first region and a second region facing the photoreceptor, the first region is of a predefined roughness, and $J>h\times(\cos\alpha/\sin\beta)\times d$, where $\alpha$ is an angle between the first region and a tangent plane of the second region, $\beta$ is an angle between the first region and a tangent line of the surface of the photoreceptor at a point of contact with the cleaning blade, h is an amount of depletion of the cleaning blade in a direction perpendicular to the surface of the photoreceptor at the point of contact when the surface of the photoreceptor travels a unit of distance, and d is a predicted total travel distance of the surface of the photoreceptor in a defined time period.

12 Claims, 6 Drawing Sheets

FIG. 10

| | Conditions | | | | Evaluation | | | | |
|---|---|---|---|---|---|---|---|---|---|
| | Blade material | Blade surface roughness (Rz/Ry) | Photo-receptor OCL | Photoreceptor surface HU value | Photo-receptor drive torque | Image flow due to discharge product | Cleaning failure due to blade wear | Photoreceptor damage (cleaning failure due to damage) | Photoreceptor wear (durability) |
| Embodiment example 1 | SUS304 | 1 μm/3 μm | Yes | 200 | ○ | ○ | ○ | ○ | △ |
| Embodiment example 2 | SUS304 | 1 μm/3 μm | Yes | 230 | ○ | ○ | ○ | ○ | △ |
| Embodiment example 3 | SUS304 | 1 μm/3 μm | Yes | 250 | ○ | ○ | ○ | ○ | ○ |
| Embodiment example 4 | SUS304 | 1 μm/3 μm | Yes | 300 | ○ | ○ | ○ | ○ | ○ |
| Embodiment example 5 | SUS304 | 1 μm/3 μm | Yes | 350 | ○ | ○ | ○ | ○ | ○ |
| Embodiment example 6 | SUS304 | 1 μm/3 μm | Yes | 370 | ○ | ○ | △ | ○ | ○ |
| Embodiment example 7 | SUS304 | 1 μm/3 μm | Yes | 400 | ○ | ○ | △ | ○ | ○ |
| Embodiment example 8 | SUS304 | 0.01 μm/0.2 μm | Yes | 250 | ○ | ○ | ○ | △ | ○ |
| Embodiment example 9 | SUS304 | 0.01 μm/0.2 μm | Yes | 350 | ○ | ○ | ○ | △ | ○ |
| Embodiment example 10 | SUS304 | 0.01 μm/0.2 μm | Yes | 400 | ○ | ○ | △ | △ | ○ |
| Comparative example 1 | SUS304 | 1 μm/3 μm | No | 160 | ○ | ○ | ○ | ○ | × |
| Comparative example 2 | SUS304 | 0.01 μm/0.2 μm | No | 160 | ○ | ○ | ○ | × | × |
| Comparative example 3 | SUS304 | 2 μm/9 μm | No | 160 | ○ | ○ | × | △ | × |
| Comparative example 4 | Polyurethane | 1 μm/3 μm | No | 160 | × | ○ | △ | ○ | × |
| Comparative example 5 | Polyurethane | 1 μm/3 μm | Yes | 250 | × | × | △ | ○ | ○ |
| Comparative example 6 | Polyurethane | 1 μm/3 μm | Yes | 350 | × | × | × | ○ | ○ |
| Comparative example 7 | Polyurethane | 1 μm/3 μm | Yes | 400 | × | × | × | ○ | ○ |

IMAGE FORMING APPARATUS

This Application is based and claims the priority of Japanese Patent Application No. 2015-038554 filed on Feb. 27, 2015 in Japan, the contents of which are hereby incorporated by reference.

BACKGROUND OF THE INVENTION (1) Field of the Invention

The present invention relates to image forming devices that charge a surface of a photoreceptor, expose the surface of the photoreceptor to light to form an electrostatic latent image on the photoreceptor, develop the electrostatic latent image to form a toner image, transfer the toner image from the photoreceptor to a transfer target, and subsequently clean the surface of the photoreceptor by using a cleaning member.

(2) Description of the Related Art

In the field of image forming devices, as a method of charging a photoreceptor, a charging method is widely employed of physically contacting the photoreceptor with a charging member such as a charging roller.

This contact charging method can reduce environmental impact by producing a smaller amount of electrical discharge product such as ozone and NOx than a corona discharge method that uses a charger wire that does not physically contact the photoreceptor. However, even though the amount of discharge product is small, the discharge product easily attaches to the surface of the photoreceptor because the contact charging method uses physical contact between the photoreceptor and the charging member.

Discharge product attached to the surface of the photoreceptor can, for example, greatly lower electrical resistance when moisture is absorbed under high temperature and high humidity conditions, making the occurrence of disturbance ("image flow") of an electrostatic latent image on the surface of the photoreceptor more likely.

As a method of cleaning discharge product from a photoreceptor, conventionally, a cleaning method is widely employed in which an end portion of a cleaning blade composed of a rubber such as polyurethane presses against the surface of the photoreceptor in a state of elastic deformation while the photoreceptor rotates. According to the frictional force between the surface of the photoreceptor and the cleaning blade, both the surface of the photoreceptor and the cleaning blade are very gradually worn away over a long period of time.

However, by adopting this configuration, a photosensitive layer of the photoreceptor is gradually worn away, and therefore stability of charging potential of the photoreceptor cannot be maintained over a long period of time, and product life of the photoreceptor is shortened.

Document JP 2011-95297 discloses a configuration intended to lengthen product life of a photoreceptor, according to which an organic photoreceptor is provided with a resin layer (hereafter, "overcoat layer") on a photoreceptor layer to protect the photoreceptor layer, improving depletion and abrasion resistance of the photoreceptor layer.

However, a photoreceptor that has an overcoat layer as an outermost layer has a relatively high hardness, which causes only the cleaning blade composed of a rubber to be worn away by the frictional force.

According to a configuration of a photoreceptor that has an overcoat layer and a cleaning blade composed of a rubber, the cleaning method of cleaning off discharge product while the surface of the photoreceptor is gradually worn away is not possible, and therefore cleaning off discharge product only by using scraping force of elastic force of the cleaning blade becomes difficult, making accumulation of discharge product on the photoreceptor more likely.

SUMMARY OF THE INVENTION

The present invention aims to provide an image forming device that reduces environmental impact, increases product life of the photoreceptor, and maximizes cleaning off residue including discharge product from the surface of the photoreceptor.

These aims are achieved by an image forming device comprising: a photoreceptor that is a rotatable body including a protective layer covering a photoreceptor layer, the protective layer being harder than the photoreceptor layer; a charger that charges the photoreceptor by using a physical contact process; and a metal cleaning blade that cleans a surface of the photoreceptor, an end of the cleaning blade contacting the surface of the photoreceptor and disposed facing in a direction counter to a direction of rotation of the photoreceptor, wherein the cleaning blade includes a first portion from the end of the cleaning blade to a position M that is a distance J from the end of the cleaning blade and a second portion that extends from the position M without overlapping the first portion, a surface of the first portion that faces the photoreceptor being a first region and a surface of the second portion that faces the photoreceptor being a second region, the first region is of a predefined roughness, and $J>h\times(\cos\alpha/\sin\beta)\times d$, where $\alpha$ is an angle between the first region and a tangent plane of the second region at the position M, $\beta$ is an angle between the first region and a tangent line of the surface of the photoreceptor at a point of contact with the cleaning blade, h is an amount of depletion of the cleaning blade in a direction perpendicular to the surface of the photoreceptor at the point of contact when the surface of the photoreceptor travels a unit of distance, and d is a predicted total travel distance of the surface of the photoreceptor in a defined time period.

BRIEF DESCRIPTION OF THE DRAWINGS

These and the other objects, advantages and features of the invention will become apparent from the following description thereof taken in conjunction with the accompanying drawings which illustrate a specific embodiment of the invention.

FIG. 10 shows experimental results such as presence/absence of image flow due to discharge product for a plurality of embodiment examples and comparative examples.

DESCRIPTION OF PREFERRED EMBODIMENT

The following describes an embodiment of an image forming device pertaining to the present invention using an example of a tandem-type color printer (hereafter, "printer").

(1) Overall Configuration of Printer

Figure 1:
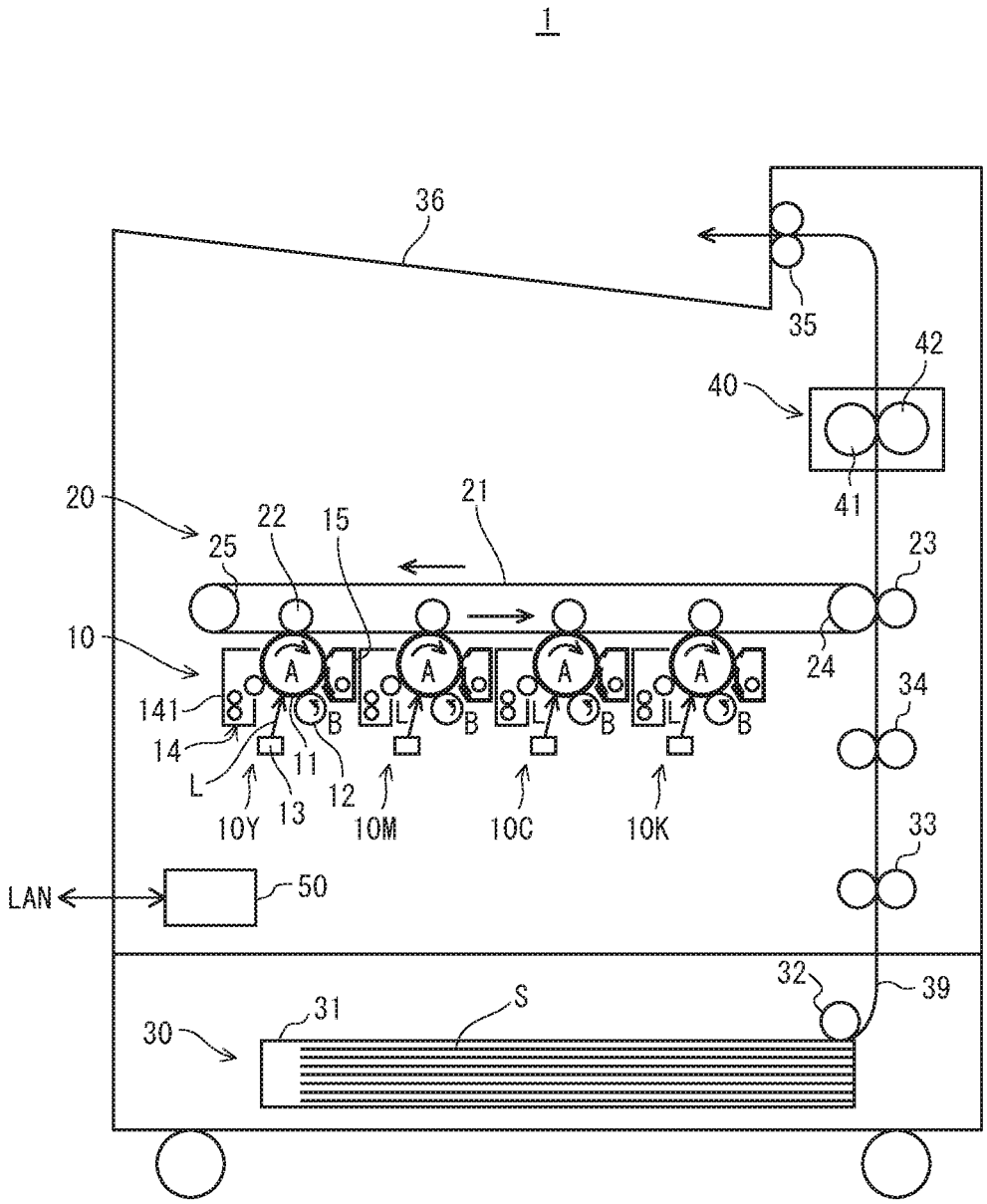
FIG. 1 illustrates an overall configuration of a printer.

FIG. 1 illustrates an overall configuration of a printer 1.

As illustrated in FIG. 1, the printer 1 is a printer for forming images by using an electrophotographic method, comprises an image processor 10, an intermediate transfer unit 20, a feeder 30, a fixer 40, and a controller 50, and executes color image forming ("printing") based on an execution request of a job from an external terminal device (not illustrated) received via a network (for example, a LAN).

The image processor 10 includes imaging units 10Y, 10M, 10C, 10K, which correspond to developer colors yellow (Y), magenta (M), cyan (C), and black (K), respectively.

The imaging unit 10Y comprises a photoreceptor drum 11, which is an organic photoreceptor, and a charging roller 12, an exposure unit 13, a developer unit 14, a cleaner 15, etc., disposed in an area surrounding the photoreceptor drum 11.

The charging roller 12 is a roller that implements a contact charging method, according to which the charging roller 12 physically contacts a surface of the photoreceptor drum 11, which rotates in the direction indicated by an arrow A, and charges the photoreceptor drum 11 while rotating in the direction indicated by an arrow B.

The exposure unit 13 exposes the charged photoreceptor drum 11 to a light beam L, thereby forming an electrostatic latent image on the photoreceptor drum 11.

The developer unit 14 contains, within a housing 141, developer that includes yellow toner particles, and develops the electrostatic latent image on the photoreceptor drum 11 by using the yellow toner. Thus, a yellow toner image is formed on the photoreceptor drum 11. Here, average particle diameter of the toner is, for example, 4 μm to 5 μm, and for each particle of toner, an external additive that is a fine powder such as silica ($SiO_2$) of average particle diameter 0.2 μm may be added to a surface of the particle of toner, in order to improve fluidity, chargeability, cleaning properties, etc., of the particle of toner. Note that fine powder of titanium oxide, alumina, etc., may also be used as the external additive.

The yellow toner image formed on the photoreceptor drum 11 is initially transferred onto an intermediate transfer belt 21 of an intermediate transfer unit 20.

The cleaner 15 cleans the surface of the photoreceptor drum 11 by using a cleaning blade comprising a metal, cleaning off toner and paper particles that remain on the surface of the photoreceptor drum 11 after the initial transfer, as well as discharge product generated and attached to the surface of the photoreceptor drum 11 when charging is performed by the charging roller 12. Note that the other imaging units 10M, 10C, 10K are configured similarly to the imaging unit 10Y, and reference signs thereof are omitted from FIG. 1.

The intermediate transfer unit 20 comprises a drive roller 24, a driven roller 25, the intermediate transfer belt 21 that is tensioned by the drive roller 24 and the driven roller 25 and travels in a circular direction indicated by arrows, initial transfer rollers 22 disposed opposite the imaging units 10Y, 10M, 10C, 10K with the intermediate transfer belt 21 therebetween, and a secondary transfer roller 23 disposed opposite the drive roller 24 with the intermediate transfer belt 21 therebetween.

The feeder 30 comprises a cassette 31 that contains sheets, here sheets S, a roller 32 that feeds the sheets S sheet-by-sheet along a transport path 39, and transport rollers 33, 34 that transport the sheets S that are fed thereto.

The fixer 40 comprises a fixing roller 41 and a pressure roller 42 that presses against the fixing roller 41.

The controller 50 centralizes control of operation of elements from the image processor 10 to the fixer 40, to smoothly execute jobs.

Specifically, for each of the imaging units 10Y, 10M, 10C, 10K, the photoreceptor drum 11 is charged by the charging roller 12. Subsequently, for each of the imaging units 10Y, 10M, 10C, 10K, a light beam L is emitted from the exposure unit 13, based on image data for printing included in a received job.

Subsequently, for each of the imaging units 10Y, 10M, 10C, 10K, an electrostatic latent image is formed on the photoreceptor drum 11 by the light beam L emitted from the exposure unit 13, the electrostatic latent image is developed to form a toner image, and the toner image is initially transferred onto the intermediate transfer belt 21 by electrostatic action of the initial transfer roller 22.

Imaging operations of each of the imaging units 10Y, 10M, 10C, 10K are executed at staggered timings so that each color of toner image is transferred onto the same area of the intermediate transfer belt 21 while the intermediate transfer belt 21 travels upstream to downstream in a travel direction.

Synchronized with these imaging operations, the sheets S are transported from the cassette 31 to the secondary transfer roller 23 so that when one of the sheets S passes between the secondary transfer roller 23 and the intermediate transfer belt 21, a multiple-transfer toner image on the intermediate transfer belt 21 undergoes a secondary transfer onto the one of the sheets S via electrostatic action of the secondary transfer roller 23.

After the secondary transfer, the one of the sheets S is transported to the fixer 40 and the toner on the one of the sheets S is fixed by fusing to the one of the sheets S via the addition of heat and pressure when passing between the fixing roller 41 and the pressure roller 42 of the fixer 40. The sheets S that pass through the fixer 40 are ejected onto an ejection tray 36 by an ejection roller 35.

(2) Configuration of Photoreceptor Drum, Charging Roller, and Cleaner

Figure 2:
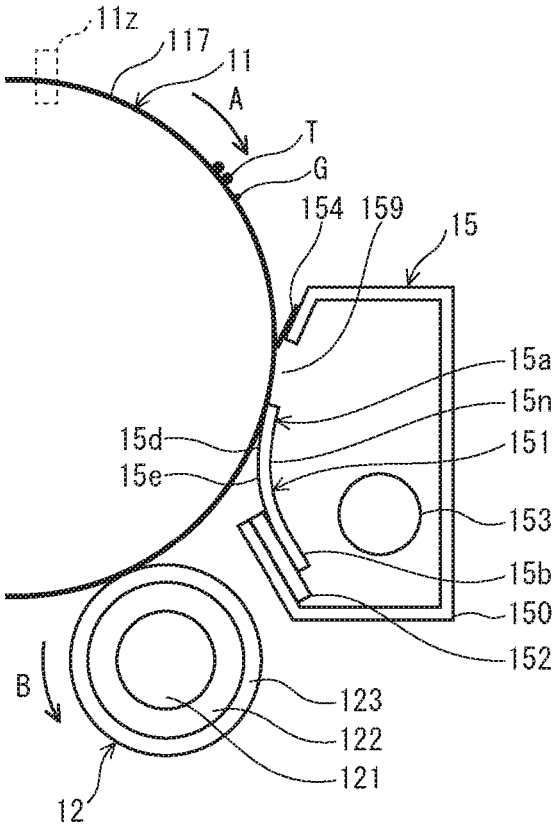
FIG. 2 illustrates an enlargement of a configuration of a photoreceptor drum, a charge controller, and a cleaner.
Figure 3:
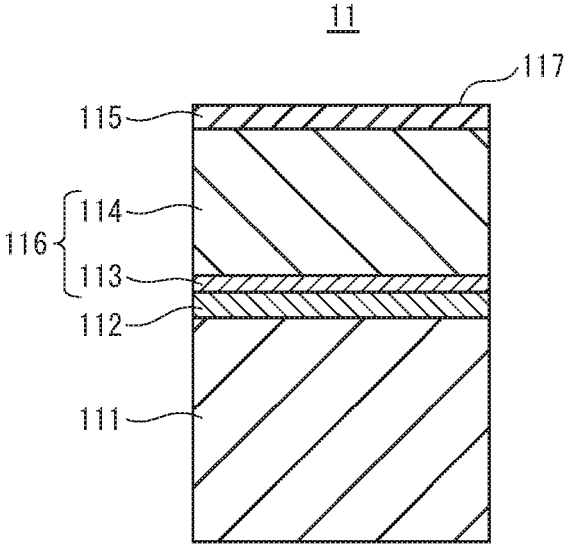
FIG. 3 illustrates a cross-section of a portion Z of the photoreceptor drum indicated by the dashed line in FIG. 2.

FIG. 2 illustrates an enlargement of a configuration including the photoreceptor drum 11, the charging roller 12, and the cleaner 15. FIG. 3 illustrates a cross-section of a portion Z of the photoreceptor drum 11 indicated by a dashed line in FIG. 2.

As indicated in FIG. 2, the charging roller 12 comprises a rotation axis 121, which comprises a metal, an elastic layer 122, which comprises an electrically conductive elastic material, and a surface layer 123, which comprises an electrically conductive resin coating material. The elastic layer 122 and the surface layer 123 are layered over the rotation axis 121 in this order. The charging roller 12 is elongated in a direction parallel to a rotation axis 121 of the photoreceptor drum 11 (a direction perpendicular to the plane of the drawings: hereafter, "drum axis direction").

A charging bias voltage outputted from a charger (not illustrated) is applied to the rotation axis 121 of the charging roller 12. According to the present embodiment, charging polarity of the photoreceptor drum 11 is negative, and therefore the charging bias voltage is a negative voltage.

When the charging bias voltage is applied to the rotation axis 121 of the charging roller 12, charging bias voltage is supplied to the surface layer 123 via the elastic layer 122, causing a potential difference between the surface layer 123 of the charging roller 12 and a surface 117 of the photoreceptor drum 11.

This potential difference, according to Paschen's law, causes a spark discharge in the vicinity of portions of the surface layer 123 of the charging roller 12 and the surface 117 of the photoreceptor drum 11 that are in contact, and the photoreceptor drum 11 is charged. According to this charging, discharge product such as ozone is generated and attaches to the surface of the photoreceptor drum 11.

The photoreceptor drum 11, as illustrated in FIG. 3, comprises a substrate body 111, and an undercoat layer (UCL) 112, a charge generation layer (CGL) 113, a charge transport layer (CTL) 114, and an overcoat layer (OCL) 115 layered in this order on the substrate body 111.

The charge generation layer 113 generates charge according to light exposure, the charge transport layer 114 transports holes generated by the charge generation layer 114, and the undercoat layer 112 guides electrons generated at the charge generation layer 113 to the substrate body 111. The charge generation layer 113 and the charge transport layer 114 are together referred to as a photoreceptor layer 116.

The overcoat layer 115 is a protective layer that protects the charge transport layer 114. The overcoat layer 115 comprises a resin that includes metal oxide, and is formed by coating the charge transport layer 114. Universal hardness (HU) of the overcoat layer 115 after coating is, for example, from 250 to 350, and is harder than the photoreceptor layer 116. The overcoat layer 115 is detailed in JP 2011-95297, for example.

Specifically, the overcoat layer 115 is a resin layer containing metal oxide particles, and may be formed by a chemical bond being formed between the resin component of the resin layer and the surfaces of the metal oxide particles. Alternatively, after a process using oxides or hydroxides, and in the presence of metal oxide particles subjected to a process using a silane compound that has unsaturated bonds or epoxy bonds, a polymerizable monomer may be reacted and formed.

By providing the overcoat layer 115 having high hardness as an outermost layer of the photoreceptor drum 11, resistance to charging can be increased, depletion due to contact with the cleaning blade 151 can be suppressed, and product life of the photoreceptor drum 11 can be increased.

Thickness of the overcoat layer 115 is predefined by experimentation, etc., so that even after depletion during a period from the start to the end of a product life of the printer 1, a minimum thickness of the overcoat layer 115 necessary to protect the charge transport layer 114 remains. When thickness of the overcoat layer 115 is increased, charge-transporting property of the overcoat layer 115 is lowered, hindering charge transport, and furthermore a quantity of material required to form the overcoat layer 115 increases, leading to higher costs. Accordingly, thickness of the overcoat layer 115 is preferably designed to be a thickness in a range that protects the charge transport layer 114 during the period from the start to the end of the product life of the printer 1, that does not hinder charge transport, and that results in low costs. According to the present embodiment, the overcoat layer 115 has an example thickness from 3 μm to 4 μm.

The cleaner 15 comprises a housing 150, the cleaning blade 151, a blade support member 152, a waste toner transport screw 153, and a toner seal 154. The housing 150, the cleaning blade 151, the blade support member 153, and the toner seal 154 are each elongated in a direction parallel to the drum axis direction.

The housing 150 is composed of resin, holds the cleaning blade 151, the blade support member 152, the waste toner transport screw 153, and the toner seal 154, and has an opening 159 facing the photoreceptor drum 11.

The cleaning blade 151 is a metal sheet, the metal having a high corrosion resistance such as stainless steel, phosphor bronze, brass, etc., with stainless steel being particularly suitable due to its high strength and fatigue life. Thickness of the cleaning blade 151 is preferably from 0.03 mm to 0.1 mm, for example, in order to ensure effective conformance with the photoreceptor drum 11.

The cleaning blade 151 contacts the surface 117 of the photoreceptor drum 11 (hereafter, "drum surface 117"), an end portion 15*a* of the cleaning blade 151 facing an opposite direction (counter direction) to a rotation direction A of the photoreceptor drum 11.

A base portion 15*b* at an opposite end of the cleaning blade 151 to the end portion 15*a* is fixed to the blade support member 152. The blade support member 152 is fixed to a lower edge that defines the opening 159 of the housing 150.

A free length of the cleaning blade 151 is defined by a fixing position of the cleaning blade 151 to the blade support member 152, and a contact angle between the end portion 15*a* of the cleaning blade 151 and the drum surface 117 is defined by how far a fixing position of the blade support member 152 to the housing 150 is from the photoreceptor drum 11.

The free length of the cleaning blade 151 is a leaf spring, the end portion 15*a* of the cleaning blade 151 being pressed and bent in a state of contact with the drum surface 117. Magnitude of this pressing force (contact force) is determined by magnitude of restoring force of the leaf spring portion of the cleaning blade 151. According to this pressing force, the end portion 15*a* of the cleaning blade 151 is kept in close contact with the drum surface 117. Remaining toner T and discharge product (not illustrated) attached to the drum surface 117 after a transfer is scraped off and removed from the photoreceptor drum 11 by the end portion 15*a* of the cleaning blade 151.

In FIG. 2, particles G attached to the drum surface 117 with the remaining toner T indicate external additive separated from toner particles T. Separation of external additive from toner particles frequently occurs when developer is agitated and transported in the housing 141 of the developer unit 14.

Specifically, when agitated and transported in the housing 141, the toner particles T are subjected to mechanical stress when contacting a transport roller, regulating blade, etc., in the developer unit 14. According to this stress, the particles G that are a portion of the external additive (fine particles) added to the toner particles T, separate from surfaces of the toner particles T. While the particles G that have separated from the toner particles T may remain in the housing 141, they may also be transferred to the drum surface 117 along with and attached to the toner particles T when developing is performed.

The particles G that are transferred to the photoreceptor drum 11 may be transferred and attach to the sheets S from the drum surface 117 when transferring is performed, or may remain on the drum surface 117. The particles G illustrated in FIG. 2 are particles that have remained on the drum surface 117. Further, a case may occur in which the particles G separate from surfaces of the toner particles T due to impact when the toner particles T that remain on the drum surface 117 after transferring contact the cleaning blade 151.

Normally, the external additive is a colorless light-transmissive material in the form of fine particles, and only a portion separates from the toner particles T, and therefore even when a portion of the particles G attach to the sheets S, the external additive does not become a cause of image quality deterioration.

Among the particles G that remain on the drum surface 117 after transferring, a majority can be scraped off by the cleaning blade 151, but a portion may enter a gap between the drum surface 117 and the cleaning blade 151. Such particles G act as a lubricant, decreasing contact friction between the drum surface 117 and the cleaning blade 151.

In order to achieve this decrease in contact friction, according to the present embodiment, surface roughness of a surface 15*d* of the cleaning blade 151 is defined so that entry of the toner particles T between the drum surface 117 and the cleaning blade 151 is not permitted and entry of the particles G between the drum surface 117 and the cleaning blade 151 is permitted. This definition is described later.

Among the particles G that enter a gap between the drum surface 117 and the cleaning blade 151, a portion passes under the cleaning blade 151. While the photoreceptor drum 11 rotates, the particles G that pass under the cleaning blade 151 are transferred onto the sheets S during transferring, scraped off by the cleaning blade 151, etc., but at the same time new particles G are transferred to the photoreceptor drum 11 from the developer unit 14. Accordingly, a given quantity of the particles G is constantly maintained in the gap between the drum surface 117 and the cleaning blade 151.

The use of the particles G as lubricant with the cleaning blade 151 that is a metallic thin plate can achieve a reduction in rotary drive torque when compared with a rubber cleaning blade that is brought into close contact with the drum surface 117 by elastic deformation.

Corners of the end portion 15*a* of the cleaning blade 151 are preferably rounded, in order to prevent the corners of the end portion 15*a* of the cleaning blade 151 from piercing and causing damage to the drum surface 117. Radius of the rounded corners can be in a range from 1 mm to 4 mm, but may be any size determined to be appropriate for a given device.

The waste toner transport screw 153 is disposed within the housing 150 and transports, in an axis direction of the waste toner transport screw 153, residue such as residue toner and discharge product that is scraped from the photoreceptor drum 11 by the cleaning blade 151 and enters the housing 150 through the opening of the housing 150, transporting the residue to be contained in a waste toner box (not illustrated).

The toner seal 154 is disposed in a position upstream of the cleaning blade 151 in the rotation direction of the photoreceptor drum 11 at an upper end of the opening 159 of the housing 150. The toner seal 154 prevents residue toner, etc., suspended in the housing 150 after the cleaning blade 151 scrapes the photoreceptor drum 11 from exiting the housing 150 via the opening of the housing 150 and scattering in the vicinity of the photoreceptor drum 11.

(3) Cleaning Blade

Figure 4:
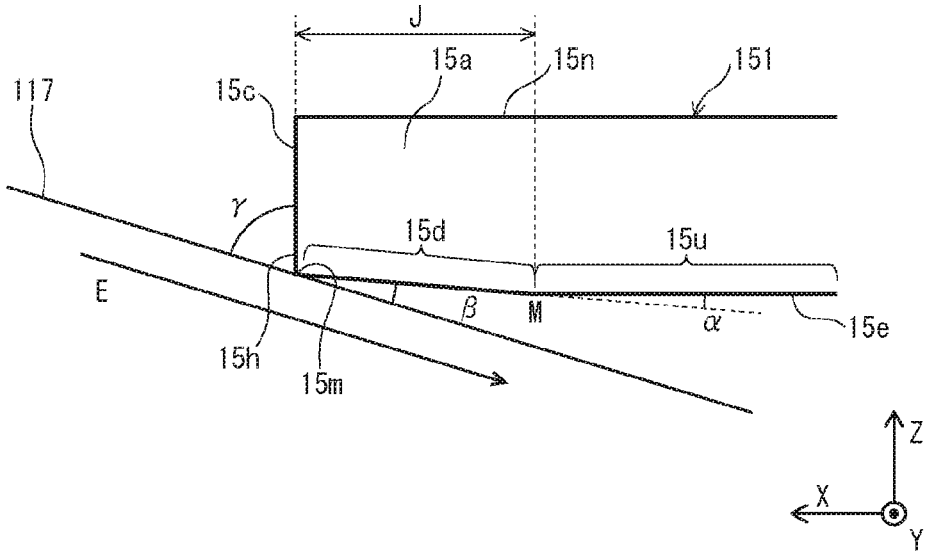
FIG. 4 is an enlarged schematic side view of an end of a cleaning blade in contact with a surface of the photoreceptor drum in a direction counter to a direction of rotation.

FIG. 4 is an enlarged schematic side view of the end 15*a* of the cleaning blade 151 in contact with the drum surface 117 in a direction counter to a direction of rotation. In FIG. 4, the X-axis direction is a width direction X of the cleaning blade 151, the Y-axis direction (corresponding to the drum axis direction) is a length direction Y of the cleaning blade 151, and the Z-axis direction is a thickness direction Z of the cleaning blade 151.

A surface of the end portion 15*a* of the cleaning blade 151 in the thickness direction Z of the cleaning blade 151 is referred to as a cut face 15*c*. Further, a surface of the cleaning blade 151 that faces the drum surface 117 is referred to as a front face 15*e* and a surface on the opposite side of the cleaning blade 151 is referred to as a back face 15*n*.

Further, when the surface 15*e* is divided into a first region 15*d* from an end at the cut face 15*c* to a position M that is a distance J from the cut face 15*c* in the width direction X and a second region 15*u* that extends in an opposite direction to the cut face 15*c* (towards the base portion 15*b*) from the position M, the first region 15*d* is a surface that has been subjected to a grinding process to achieve a smooth surface of a predefined roughness and the second region 15*u* is not subjected to the grinding process. Further, the position M is a boundary between the first region 15*d* and the second region 15*u*. Hereafter, the first region 15*d* is referred to as a polished region 15*d*.

In FIG. 4, a portion 15*m* of the polished region 15*d* that is in contact with the cut face 15*c* is illustrated in contact with the drum surface 117. Note that the drum surface 117 is actually rounded in cross-section, but is illustrated in FIG. 4 as a straight line as a tangent line at the point at which the portion 15*m* of the cleaning blade 151 contacts the drum surface 117. A direction indicated by an arrow E is the travel direction of the drum surface.

(4) Cleaning Blade Grinding Process

Figure 5:
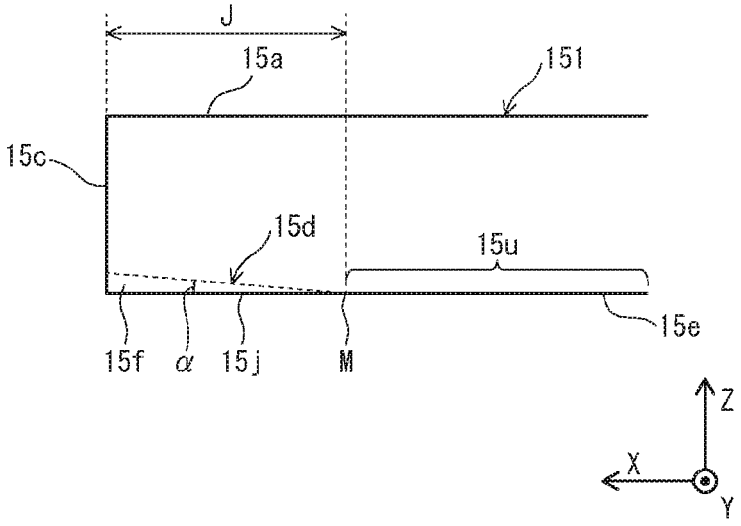
FIG. 5 is a schematic side view illustrating a state of the end of the cleaning blade prior to grinding.

FIG. 5 is a schematic side view illustrating a state of the end portion 15*a* of the cleaning blade 151 prior to the grinding process. An end portion 15*f* of the front face 15*e* of the end portion 15*a* of the cleaning blade 151 indicates a portion to be scraped away by the grinding process, and the dashed line 15*d* indicates the polished region 15*d* after the grinding process.

When the front face 15*e* of the cleaning blade 151 is viewed as a straight line viewed from the side, a portion from the cut face 15*c* to the position M along the width direction X of the cleaning blade 151 is ground away to result in an angle $\alpha$ (for example 5°) between the front face 15*e* prior to the grinding process and the polished region 15*d* after the grinding process. In other words, when viewed from the side, the polished region 15*d* (the first region) is angled away from the drum surface 117 so that the angle $\alpha$ about the position M exists between the polished region 15*d* and a virtual extension line 15*j* extended from the second region 15*u* of the front face 15*e* of the cleaning blade 151. In other words, the angle $\alpha$ is an angle between the polished region 15*d* and a tangent plane of the second region 15*u* at the position M.

Figure 6:
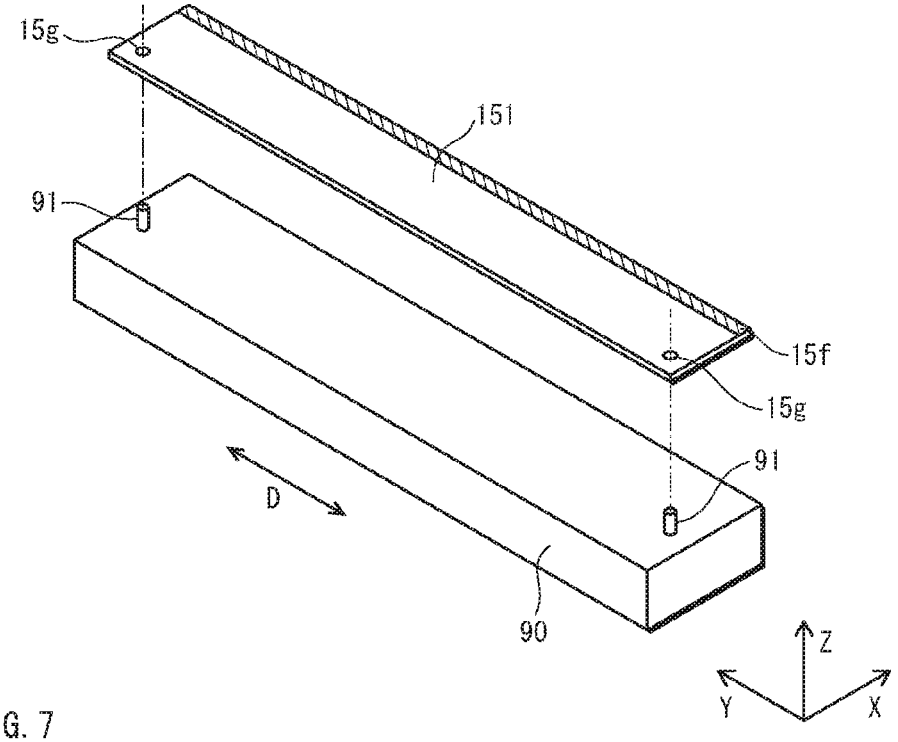
FIG. 6 is a schematic diagram illustrating a grinding base used in grinding of a surface of the cleaning blade.
Figure 7:
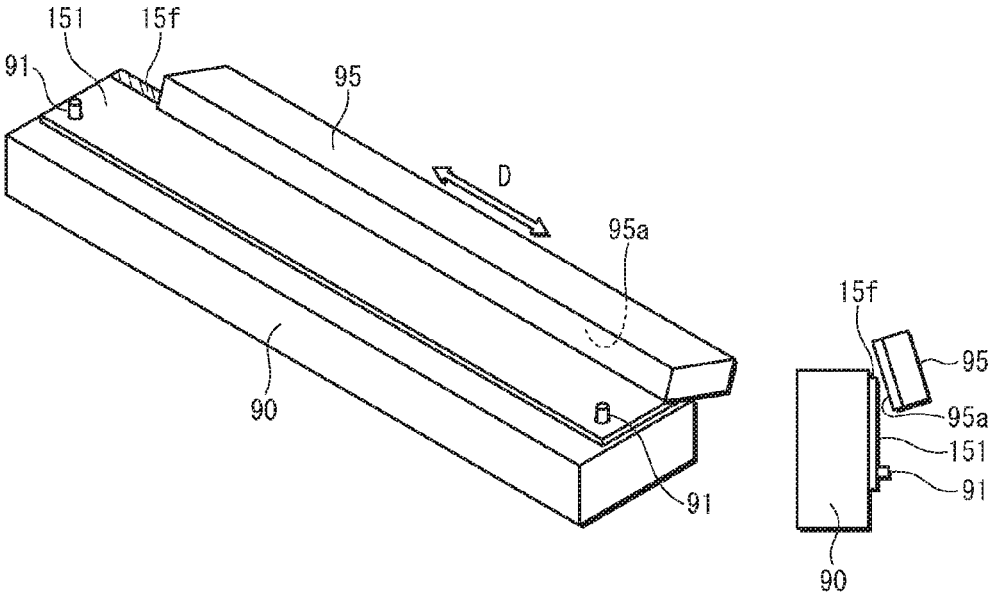
FIG. 7 is a schematic diagram illustrating a grinding tool used in grinding of the surface of the cleaning blade.

The grinding of the cleaning blade 151 can be performed by using a grinding tool 95, as illustrated in FIG. 7, while the cleaning blade 151 is fixed to a grinding base 90, as illustrated in FIG. 6.

Fixing of the cleaning blade 151 to the grinding base 90, which has a low roughness, is performed by fitting two pins 91 provided to the grinding base 90 to two through holes 15*g* provided to the cleaning blade 151, as illustrated in FIG. 6. The through holes 15*g* of the cleaning blade 151 are provided to predefined positions that do not hinder cleaning properties of the cleaning blade 151.

The grinding of the cleaning blade 151 is performed by moving the grinding tool 95 back-and-forth in a D-direction (a direction parallel to the drum axis direction) while the cleaning blade 151 is fixed to the grinding base 90 and a surface 95*a* of the grinding tool 95 that has a low roughness is in contact with the end portion 15*f* of the cleaning blade 151, as illustrated in FIG. 7. Grinding particles, i.e., alumina particles (having a particle radius of 0.3 μm to 10 μm, for example) are deposited on the surface 95*a* of the grinding tool 95.

The contact area and contact angle between the grinding tool 95 and the end portion 15*f* of the cleaning blade 151 is adjusted so that the grinding by the grinding tool 95 forms the polished region 15*d* having a smooth surface that is inclined by the angle α in the range defined by the distance J, as indicated in FIG. 5.

The grinding is performed so that the surface roughness of the polished region 15*d* of the cleaning blade 151 achieves a ten-point mean roughness Rz and a local maximum height Ry, as defined by Japanese Industrial Standard (JIS) B 0601(1994), within respective predefined ranges.

Specifically, ten-point mean roughness Rz of the polished region 15*d* is greater than an average particle diameter of a portion of the external additive G that is separated from surfaces of the toner particles T and attached to the drum surface 117, in the present embodiment silica particles (0.2 μm), and local maximum roughness Ry of the polished region 15*d* is less than an average particle diameter of the toner particles T (4 μm to 5 μm).

Average particle diameter of the toner and the external additive can be expressed as median diameter. Median diameter is the diameter of a particle at a midpoint of a particle diameter distribution of all particles. As a measuring instrument, a wet-flow-type particle diameter and shape analyzer such as FPIA-3000 (Sysmex corp.) may be used for toner and a laser diffraction/scattering-type particle diameter distribution measuring apparatus such as Microtrac 330011 (MicrotracBEL corp.) may be used for external additive.

On the other hand, surface roughness is obtained using a reference length of 0.25 mm and an evaluation length of 1.25 mm along the drum axis direction. Hereafter, ten-point mean roughness Rz and local maximum height Ry are referred to surface roughness Rz and Ry, respectively.

In the present embodiment, as one example, surface roughness Rz is greater than 0.2 μm and less than 0.4 μm, and surface roughness Ry is less than 4 μm. Note that when average particle diameter of toner particles has a certain range, surface roughness Ry is less than a minimum value of average particle diameter of toner particles.

Further, when a plurality of different types of external additive are added to the toner particles, and the plurality of different types become free external additives, the average particle diameter of an external additive among the plurality of different types that has a greatest diameter defines surface roughness Rz.

Average particle diameter of the toner particles T included in the developer of the developer unit 14 and average particle diameter of the particles G of the external additive added to the toner particles T define surface roughness Ry, Rz of the polished region 15*d* of the cleaning blade 151; this is to ensure cleaning of residue toner from the drum surface 117, and prevent damage to the surface of the photoreceptor drum 11 caused by contact between the cleaning blade 151 and the drum surface 117.

In other words, because surface roughness Ry is less than the average particle diameter of the toner particles, residue toner attached to the drum surface 117 after transferring arrives at the position 15*m* where the cleaning blade 151 contacts the drum surface 117 according to rotation of the photoreceptor drum 11 and is prevented from passing through a gap between the drum surface 117 and the cleaning blade 151, thus ensuring cleaning of residue toner.

Further, because surface roughness Rz is greater than the average particle diameter of the external additive, when the particles G of external additive attached to the drum surface 117 after transferring arrive at the position 15*m*, the cut face 15*c* of the cleaning blade 151 is a wall, the particles G accumulate at an end 15*h* nearer the drum surface 117 of the cut face 15*c*, and among the accumulated particles of external additive, a portion enter concavities of surface roughness of the polished region 15*d* and thereby enter gaps between the drum surface 117 and the cleaning blade 151.

In other words, the particles G of external additive are retained in the gaps between the drum surface 117 and the cleaning blade 151 and roll while entering concavities of surface roughness of the cleaning blade 151, thereby acting as lubricant, decreasing friction where the cleaning blade 151 and the drum surface 117 are in contact, and preventing damage to the drum surface 117 by the cleaning blade 151 caused by an increase in frictional force.

Further, because the particles G of external additive accumulate at the cut face 15*c*, the accumulation of the particles G acts as a wall preventing entry of residue toner into the gaps between the drum surface 117 and the cleaning blade 151, improving cleaning of residue toner.

The surface roughness Ry, Rz is measured on the basis of the reference length in a direction parallel to the drum axis direction (corresponding to the length direction Y of the cleaning blade 151). This is according to the following reasoning.

Of the polished region 15*d* of the cleaning blade 151, the portion 15*m* in contact with the drum surface 117 is an edge portion in a line parallel to the drum axis direction. Thus, by specifying surface roughness in the length direction Y of the cleaning blade 151, a state is easily formed in which lubricant layer composed of the particles G of external additive, along the drum axis direction, enters the gap between the drum surface 117 and the cleaning blade 151. On the other hand, when surface roughness is specified in the width direction X of the cleaning blade 151, only the portion 15*m* in the width direction X is in contact with the drum surface 117, and therefore it becomes more difficult to achieve the effect of maintaining the particles G as described above than when surface roughness is specified in the length direction Y FIG. 4 illustrates the portion 15*m* of an end portion of the polished region 15*d* of the cleaning blade 151 in contact with the drum surface 117, as an example of an initial state in the product life of the printer 1. However, over a long period in which the cleaning blade 151 is in contact with the drum surface 117 in the counter direction while the photoreceptor drum 11 rotates, even when the external additive functions as a lubricant as described above, friction is generated between the cleaning blade 151 and the drum surface 117, and therefore the cleaning blade 151 is gradually worn away.

Thus, over time from the initial state of the printer 1 to the end of product life of the printer 1, a position of the portion 15*m* of the cleaning blade 151 in contact with the drum surface 117 gradually moves within the polished region 15*d* in the direction of the base portion 15*b*.

Figure 8:
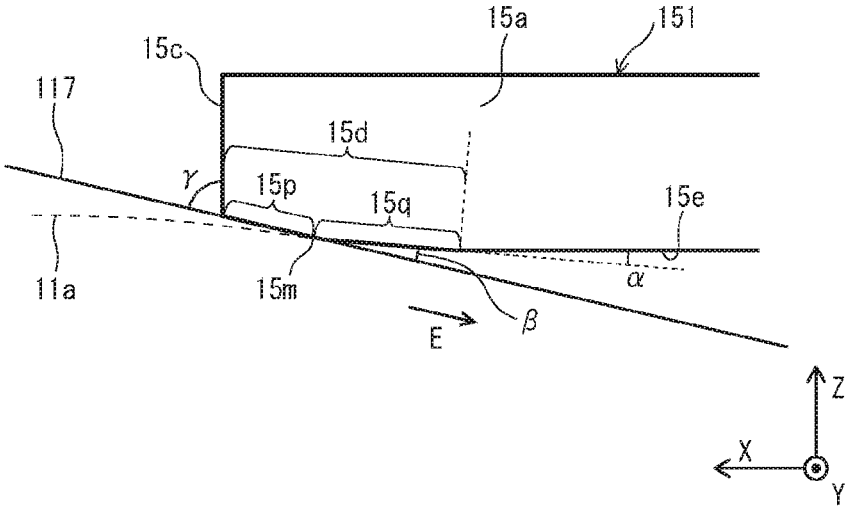
FIG. 8 is a schematic side view illustrating the cleaning blade in contact with the surface of the photoreceptor drum at a mid-point of product life of the printer.

FIG. 8 is a schematic side view illustrating the cleaning blade 151 in contact with the drum surface 117 at a mid-point of product life of the printer 1.

FIG. 8 illustrates depletion from the initial state to the mid-point of product life of the printer 1 of a depleted region 15*p* of the polished region 15*d* of the cleaning blade 151 from the cut face 15*c* to the position 15*m*, which is the current position at which the cleaning blade 151 contacts the drum surface 117. Aside from the depleted region 15*p* of the polished region 15*d*, a remaining region 15*q* is a region having surface roughness Ry, Rz as specified above.

In FIG. 8, the end portion 15*a* of the cleaning blade 151 is illustrated in a straight state along the width direction X, but actually the end portion 15*a* of the cleaning blade 151 is in a bent state as illustrated in FIG. 2. Further, the drum surface 117 illustrated in FIG. 8 is actually a circular arc in cross-section as indicated by a dashed line 11*a*.

Thus, as the polished region 15*d* of the cleaning blade 151 is depleted, the region 15*p* is not in contact with the drum surface 117 across an entirety of the region 15*p*. According to the curve of the drum surface 117 and the bend of the end portion 15*a* of the cleaning blade 151, the portion 15*m* at an edge of the depleted region 15*p*, within the polished region 15*d*, is in contact with the drum surface 117. According to an amount of depletion of the cleaning blade 151, the position of the portion 15*m* in contact with the drum surface 117 gradually moves from the cut face 15*c* in the direction of the base portion 12*b*.

During a period from the initial state to the end of the product life of the printer 1, as long as the movement of the portion 15*m* is within the polished region 15*d*, the portion 15*m* that is in the polished region 15*d*, which has the predefined values of surface roughness Ry, Rz, is always in contact with the drum surface 117, and therefore cleaning is improved and the damage to the drum surface 117 is prevented, as described above.

In other words, in order to improve cleaning and prevent damage to the drum surface 117, it suffices that the length J in the width direction X of the polished region 15*d* is specified so that the portion 15*m* in the polished region 15*d* of the cleaning blade 151 is in contact with the drum surface 117 from the initial state to the end of the product life of the printer 1.

Figure 9:
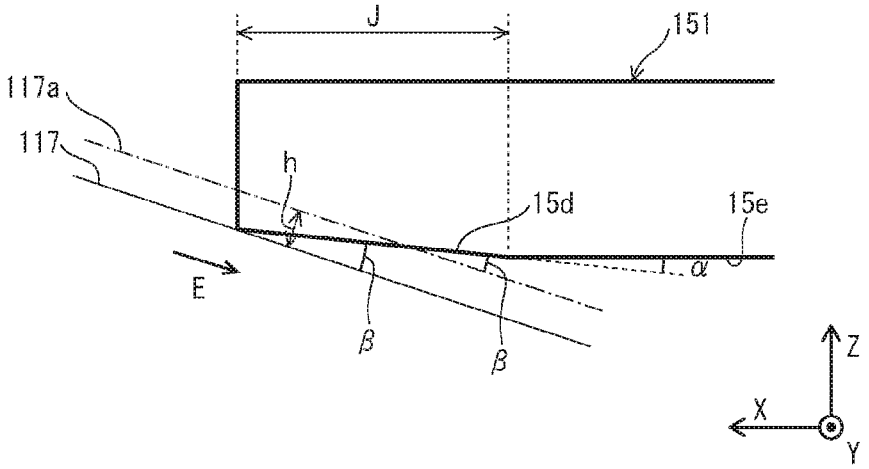
FIG. 9 is a schematic side view illustrating a state of wear of the cleaning blade when the surface of the photoreceptor drum is assumed to have traveled by a unit of travel distance.

FIG. 9 is a schematic side view illustrating a state of wear of the cleaning blade 151 when the drum surface 117 is assumed to have traveled by a unit of travel distance, in which the drum surface 117 at a start of travel is indicated by a solid line and a drum surface 117*a* at an end of travel is indicated by a dashed line.

Further, an amount of wear of the cleaning blade 151 when the drum surface 117 travels the unit of travel distance is indicated by an amount of wear h. The amount of wear h indicates a length in a direction perpendicular to a tangent line 117 at the point of contact between the drum surface 117 and the cleaning blade 151 at the start of travel.

Further, an angle α is formed between an extension line extended from the polished region 15*d* (smooth surface) of the cleaning blade 151 and the front face 15*e* (the second region 15*u*). Further, an angle β is formed between the polished surface 15*d* and the tangent line 117 at the point of contact between the drum surface 117 and the cleaning blade 151.

Where d is a value obtained by multiplying a circumferential length of the drum surface 117 over an expected number of the rotations of the photoreceptor drum 11 in the period from the initial state to the end of the product life of the printer 1, and J is a distance in the width direction X of the polished region 15*d* of the cleaning blade 151, the distance J is defined by the following equation.

$$J > h \times (\cos\alpha / \sin\beta) \times d \qquad \text{[Equation]}$$

When the distance J is specified by using this equation, the portion 15*m* in the polished region 15*d* of the cleaning blade 151 can be in contact with the drum surface 117 from the initial state to the end of the product life of the printer 1.

For example, when a unit of travel distance of the drum surface 117 is 1 km for the amount of wear h of 2 μm, the predicted total travel distance d is 50 km, the angle α is 5°, and the angle β is 15°, the distance J is 385 μm, and therefore it suffices that the grinding process is performed on an area of the front face 15*e* of the cleaning blade 151 up to 400 μm from the end of the cleaning blade 151. When the distance J (length of surface for processing) increases, the area for the grinding process increases, and therefore processing time and processing costs increase. Thus, by setting the distance J to a minimum value or value close to the minimum value that satisfies the conditions specified in the equation above, the area for the grinding process is minimized and processing time and processing costs can be suppressed.

A configuration is described above that has the angle α between an extension line from the polished region 15*d* of the cleaning blade 151 and the front face 15*e*, but, for example, the angle α may be 0°. When the angle α is 0°, the polished region becomes a region indicated by the solid line 15*j* from the cut face 15*c* to the position M, as part of the front face 15*e* of the cleaning blade 151 illustrated in FIG. 5.

When the angle α is greater than 0°, the angle β is smaller than when the angle α is 0°, and the smaller the angle β is, the greater an angle γ is, as indicated in FIG. 4. The angle γ is an angle between the tangent line 117 of the drum surface 117 and the cut face 15*c* of the cleaning blade 151.

When the angle γ is increased, it becomes easier for the cut face 15*c* of the cleaning blade 151 to scrape off residue toner and discharge product from the drum surface 117, and it becomes easier for scraped off residue toner, etc., to escape the back face 15*n* and be cleaned off.

Further, the smaller the angle β is, the easier it is for the polished region 15*d* to contact the drum surface 117 even while the cleaning blade 151 is gradually worn away over the product life of the printer 1.

Specifically, when supposing that the angle β is extremely large, it becomes easier for a portion of the depleted region 15*p* of the cleaning blade 151 near the cut face 15*c* to contact the drum surface 117. The depleted region 15*p* is assumed to have a surface roughness Ry, Rz outside the specified values, and therefore when the depleted region 15*p* contacts the drum surface 117, the drum surface 117 is more easily damaged because frictional force is greater between the drum surface 117 and the depleted region 15*p* than between the drum surface 117 and the region 15*q*, which has surface roughness Ry, Rz within the specified values.

On the other hand, the smaller the angle β is, the further the depleted region 15*p* tends to be from the drum surface 11*a* (dashed line), making it easier for the portion 15*m* to be in contact with the drum surface 117. Thus, according the surface roughness Ry, Rz, cleaning is increased and damage to the drum surface 117 is more easily prevented.

However, when the angle β is too small, the bend of the end portion 15*a* of the cleaning blade 151 becomes small, contact pressure with the drum surface 117 decreases, and therefore cleaning properties decreases due to a decrease in scraping force to remove discharge product on the drum surface 117.

An appropriate range of the angle β varies from device to device, but a typical printer configuration is preferably from 7° to 20°, with a range from 10° to 15° being more optimal. Further, a relationship such that the angle β is less than the angle γ is preferable.

The above describes how the portion 15*d* of the cleaning blade 151 that contacts the drum surface 117 is subjected to grinding processing, in which mechanical grinding is performed by using the grinding tool 95, but other methods are possible. For example, buffing using fabric, electric polishing, chemical polishing, etc., are all possible. One such method or a plurality of methods may be used.

Further, methods other than grinding, buffing and polishing may be used. Any method is acceptable that makes the surface roughness Ry, Rz smooth, within the predefined ranges, for example coating may be used. According to coating, a coating of a material that is different to the cleaning blade 151 is attached to the front face 15*e* of the cleaning blade 151, and thickness of the coating may gradually increase from the cut face 15*c* of the cleaning blade 151 towards the base portion 15*b* in order to form the angle α described above.

Coating may use diamond-like carbon (DLC), chemical vapor deposition (CVD), physical vapor deposition (PVD), polytetrafluoroethylene (PTFE), etc.

Further, a treatment process may also be applied to the cut face 15*c*. One treatment process or a combination of two or more treatment processes may be applied.

Further, the surface roughness Ry, Rz of the cleaning blade 151 is described by using an example of definition of a relationship with average particle diameter of toner particles and external additive particles, but making the surface roughness of the photoreceptor drum 11 conform to the range described above can further prevent damage to the drum surface 117. Only depletion of the cleaning blade 151 is described above, but the drum surface 117 may also be depleted.

(5) Experimental Results According to Embodiment Examples

FIG. 10 shows results of evaluation for photoreceptor drive torque, image flow due to discharge product, cleaning failure due to blade wear, photoreceptor damage, and photoreceptor wear for a plurality of experimental devices.

Here, a Konica Minolta Inc. Bizhub C654e was used as the base of the experimental devices, modifying the charging system from a corona charger to a charging roller, and changing conditions of the photoreceptor drum and the cleaning blade as indicated in FIG. 10 for embodiment examples 1 to 10 and comparative examples 1 to 7. Aside from the charging system, the photoreceptor drum, and the cleaning blade, the configuration of the Bizhub C654e was unchanged between different examples.

The charging roller had a core metal with a diameter of 8 mm, with an electrically-conductive rubber layer with a thickness of 2 mm around the outer periphery of the core metal. The surface of the electrically-conductive rubber layer was coated with an electrically-conductive material. The charging roller was configured to be in contact with a surface of the photoreceptor drum and was driven to rotate by the photoreceptor drum. The charging bias that supplied the charging roller overlapped DC with AC.

Conditions common to each of the cleaning blades were a thickness of 50 μm, a treatment process of mechanical grinding, an angle β less than an angle γ, and a distance J that satisfied the conditions of the Equation above.

The following describes the items listed in FIG. 10.

Blade material indicates material of the cleaning blade.

Blade surface roughness indicates surface roughness Rz/Ry of the cleaning blade.

Photoreceptor OCL indicates whether or not the photoreceptor drum had an overcoat layer (OCL). The photoreceptor drums not provided with an overcoat layer had the charge transport layer of the photoreceptor layer as an outer surface thereof.

Photoreceptor surface HU indicates the universal hardness (HU) of the surface of the photoreceptor drum. Universal hardness is measured by using an ultra-micro hardness tester, and therefore hardness of a very thin outer layer can be measured.

Photoreceptor drive torque indicates experimental results of drive torque of the photoreceptor drum in an initial state and after stress printing. Results were evaluated by determining whether a measured value was equal to or below 0.1 N·m, with a result equal to or below 0.1 N·m being indicated with a ○ and results over 0.1 N·m being indicated with a x.

Here, stress printing indicates that an image with a print coverage of 25% of the entire surface of an A4 sheet was printed onto 10,000 A4 sheets consecutively fed in landscape orientation through the printer. Landscape orientation means that each sheet was fed in an orientation such that a short length of the sheet was aligned in the direction of transport of the sheet.

Measurement of drive torque was performed by interposing a torque voltage converter into a drive force transmission path between the rotation axis of the photoreceptor drum and a drive motor, and reading drive torque from converted voltage values.

When photoreceptor drive torque is 0.1 N·m or less, over the product life, the load of a motor driving rotation of the photoreceptor drum 11 can be kept low, and therefore a small motor can be used, reducing costs and conserving electricity.

The photoreceptor drive torque changes according to conditions such as free length of the cleaning blade, angle of contact between the cleaning blade and the drum surface, material of the cleaning blade, etc., and therefore each is pre-set to achieve a value of 0.1 N·m or less. Compared to rubber, metal reduces frictional force between the cleaning blade and the drum surface, which can lower photoreceptor drive torque, increasing design freedom correspondingly.

Image flow caused by discharge product was evaluated according to whether or not image flow occurred when a two-by-two dot image was printed using the photoreceptor drum and cleaning blade after stress printing, and indicated by a ○ when image flow did not occur and a x when image flow did occur.

Here, stress printing indicates that an image with a print coverage of 25% of the entire surface of an A4 sheet was printed onto 1,000 A4 sheets consecutively fed in landscape orientation through the printer. After the stress printing, in a high-temperature, high-humidity (HH) environment in which image flow easily occurs, the device was left for eight hours, then the two-by-two dot image was printed. The HH environment had a temperature of 30° C. and a humidity of 85%. The two-by-two dot image was an image in which a two-by-two dot image was repeated in a regular matrix across an A4 sheet.

The printed two-by-two dot images were examined using a loupe, and a ○ indicates that the dots were formed and image flow did not occur while a x indicates that a dot was blurred and image flow occurred.

Cleaning failure due to blade wear indicates that, using the cleaning blade after stress printing, in a low temperature, low humidity (LL) environment and an HH environment, a visual inspection was performed to determine whether or not residue toner was visible on the photoreceptor drum after a solid image that was not transferred onto an intermediate transfer member was cleaned by the cleaning blade. The LL environment had a temperature of 10° C. and a humidity of 15%.

When evidence of cleaning failure was not visible, the result is indicated by a ○, when evidence of cleaning failure was confirmed, but image quality was not affected, the result is indicated by a triangle, and when evidence of cleaning failure was present and there was a problem with image quality, the result is indicated by a x. Here, stress printing conditions were the same as the stress printing conditions used for evaluating photoreceptor drive torque. The same stress printing conditions were also used in evaluating photoreceptor damage, which is described below.

Photoreceptor damage (cleaning failure due to damage), indicates evaluation results of whether or not damage was visible on the surface of the photoreceptor drum after stress printing. Visual inspection was performed using a digital microscope (VHX-500F, Keyence corp). No visible damage is indicated by a ○, visible damage but no problems with cleaning failure or image quality is indicated by a triangle, and visible damage with an image quality problem is indicated by a x.

Photoreceptor wear (durability) indicates results of evaluating whether function of the photoreceptor layer was maintained after stress printing. Here, stress printing indicates that bands of solid color with a print coverage of 25% of the entire surface of an A4 sheet were printed onto 10,000 A4 sheets consecutively fed in landscape orientation through the printer.

Evaluation of photoreceptor wear was performed by measuring thickness of the photoreceptor layer of the photoreceptor drum after the stress printing. Wear amount of the surface of the photoreceptor drum has linearity with respect to the cumulative number of prints, and therefore thickness of the photoreceptor layer can be predicted over the product life from the thickness of the photoreceptor layer after the stress printing, and whether or not the predicted thickness is sufficient to maintain function of the photoreceptor layer can be evaluated.

A thickness that is sufficient for function of the photoreceptor layer over the product life is indicated by a ○, a wear amount that is greater than that indicated by a ○, but for which at least a minimum thickness required for function of the photoreceptor layer and no problem with image quality occurs is indicated by a triangle, and insufficient thickness for function of the photoreceptor layer over the product life (wear sufficient to prevent function of the photoreceptor layer) is indicated by a x.

From the experimental results it can be seen that, as a result of the metal cleaning blade (stainless steel in the experiments), photoreceptor drive torque was reduced for the embodiment examples 1 to 10, while the photoreceptor drive torque was not reduced for the polyurethane rubber (hereafter, "rubber") blades of the comparative examples 4 to 7. Further, due to accumulation of discharge product on the surface of the photoreceptor drum, the coefficient of friction of the surface of the photoreceptor drum increases, making an increase in drive torque more likely with respect to the rubber blades of the comparative examples 4 to 7, but such an increase in drive torque of the photoreceptor drum due to accumulation of discharge product did not occur for the embodiment examples 1 to 10.

Looking at the image flow due to discharge product, it can be seen that image flow did not occur for the embodiment examples 1 to 10, due to cleaning of discharge product by the combination of the photoreceptor drum with the overcoat layer, the contact charging method, and the metal cleaning blade. Image flow did not occur for comparative example 4, which used a combination of a rubber cleaning blade and a photoreceptor drum without the overcoat layer, because discharge product was cleaned off while both the surface of the photoreceptor drum and the cleaning blade were worn away. In contrast, image flow occurred for comparative examples 5 to 7, which used a combination of a rubber cleaning blade and photoreceptor drum with the overcoat layer, because the rubber cleaning blade could not clean off discharge product from the photoreceptor drum while wearing away the overcoat layer of the photoreceptor drum.

Looking at cleaning failure due to blade wear, it can be seen that cleaning failure sufficient to cause problems with image quality did not occur for embodiment examples 1 to 10. However, embodiment examples 6, 7, and 10 each have a triangle as an evaluation result. This is thought to be because the HU values of the surfaces of the photoreceptor drums were higher than for other embodiment examples, and when the surface of the photoreceptor drum is very hard, wear of even a metal cleaning blade is high compared to other embodiment examples.

The evaluation result of comparative example 3 is a x, and this is thought to be because the surface roughness Ry of the metal cleaning blade was set to be greater than the average particle diameter of the toner particles, allowing residue toner on the surface of the photoreceptor drum to more easily pass through concavities of the surface roughness of the cleaning blade and causing cleaning failure to occur.

Further, the comparative examples 6 and 7 each have a x as an evaluation result, and this is thought to be because only the cleaning blade was quickly worn away in the initial usage of combinations of a rubber cleaning blade and a photoreceptor drum with the overcoat layer.

Looking at photoreceptor damage, it can be seen that photoreceptor damage that led to problems did not occur for any of the embodiment examples 1 to 10, even though metal cleaning blades were used, because a photoreceptor drum with a high hardness overcoat layer was used in each case. Note that the embodiment examples 8 to 10 each have a triangle as an evaluation result. This is thought to be for the following reasons. For embodiment examples 8 to 10, the surface roughness Rz of the metal cleaning blade was 0.01 μm in each case, which is less than the average particle diameter 0.2 μm of the external additive. Thus, it became difficult for the particles of external additive attached to the surface of the photoreceptor drum to enter the concavities of the surface roughness of the cleaning blade to act as lubricant, and this is thought to have decreased the effect of friction reduction between the surface of the photoreceptor drum and the cleaning blade when compared to the other embodiment examples.

Looking at the photoreceptor wear, it can be seen that function of the photoreceptor layer could be maintained until the end of the product life for each of the embodiment examples 1 to 10, even though a metal cleaning blade was used, because the photoreceptor drum with a high-hardness overcoat was used. Note that the embodiment examples 1 and 2 each have a triangle as an evaluation result. This is thought to be because the HU value of the surface of the photoreceptor drum is lower for the embodiment examples 1 and 2 than for the other embodiment examples, and therefore depletion of the surface of the photoreceptor drum due to the metal cleaning blade had advanced further than for the other embodiment examples.

From the evaluation results indicated in FIG. 10, it can be seen that for the comparative examples 1 to 4, photoreceptor wear was extreme and a long product life could not be achieved for the photoreceptor drum, because the photoreceptor drum did not have an overcoat layer in each case. It can also be seen that for the comparative examples 5 to 7, image flow due to discharge product was not prevented because the cleaning blade was rubber in each case.

As described above, according to the present embodiment, the combination of the photoreceptor drum 11 with the overcoat layer 115, the charging roller 12 that uses a contact charging method, and the cleaning blade 151 that is metal increases product life of the photoreceptor drum 11 and prevents image flow due to discharge product, as well as enabling a reduction in photoreceptor drive torque, an improvement in cleaning of residue toner, etc., and prevention of photoreceptor damage.

<Modifications>

The description above is based on an embodiment of the present invention, but the present invention is of course not limited to the embodiment described above and the following modifications are possible.

(1) According to the embodiment above, an example is described in which the charging polarity of the photoreceptor layer 116 of the photoreceptor drum 11 is negative, but, for example, a photoreceptor drum for which charging polarity is positive may be used.

Typically, ozone as discharge product is said to be generated by electrons colliding with oxygen molecules to form oxygen atoms, and the oxygen atoms then being involved in a three body collision reaction with oxygen molecules and nitrogen molecules. NOx is also generated in the same way. According to this generation, negative charging that emits electrons generates more discharge product than positive charging. In conventional printers it is known that negative charge configurations generate several times more discharge product than positive charge configurations, making image flow due to discharge product more likely. Thus, the effect of preventing image flow due to discharge product is greater in the configuration pertaining to the embodiment, which includes a photoreceptor drum having a negative charging polarity.

(2) According the embodiment above, an example is described in which the image forming device pertaining to the present invention is a tandem-type color printer, but this is merely an example. As long as a configuration charges a surface of a photoreceptor by using a charger, exposes the surface of the photoreceptor to light to form an electrostatic latent image on the photoreceptor, develops the electrostatic latent image to form a toner image, transfers the toner image from the photoreceptor to a transfer target, and subsequently cleans the surface of the photoreceptor by using a cleaning blade, the present invention may be generally applied to image forming devices such as photocopy machines, fax machines, multi-function peripherals (MFPs), etc.

When, as in the embodiment, a toner image on the photoreceptor drum 11 is transferred to an intermediate transfer member such as an intermediate transfer belt, the intermediate transfer member is the transfer target. When the toner image on the photoreceptor drum 11 is not transferred to an intermediate transfer member, but instead directly to one of the sheets S, the sheet is the transfer target.

(3) As a photoreceptor, a drum shape may be used as described above, and alternatively a belt shape may be used. Further, the overcoat layer on the photoreceptor layer of the photoreceptor body is not limited to that described in JP 2011-95297, as long as something harder than the photoreceptor layer is used.

Further, an example configuration is described that uses the charging roller 12 as a charger in a contact charging method, but as long as contact is made with the drum surface 117, a roller shape need not be used and, for example, a brush shape may be used.

As developer stored in the developer unit 14, a two-component developer including toner particles and a carrier may be used, and a single component developer including toner particles and not including a carrier may be used. Further, an example is described above in which particles of an external additive are added to toner particles, separate from the toner particles, and attach to the drum surface 117, but this is merely an example.

For example, the external additive may be contained separately to the toner particles in the developer, and the external additive may be transferred from the developer unit 14 to attach to the drum surface 117. Accordingly, external additive included in developer may contain at least one of external additive that has separated from toner particles and external additive contained separated from the toner particles in the developer.

Further, a smoothing treatment such as grinding that satisfies the conditions for surface roughness Rz, Ry of the surface of the cleaning blade 151 is described, but as long as occurrence of image flow due to discharge product is prevented, such as in the cases of the embodiment examples 8 to 10 indicated in FIG. 10, advantageous effects of the present invention can be achieved when surface roughness Rz, Ry does not satisfy the conditions.

Further, element material, size, shape, type, numerical values, toner particle diameter, external additive particle diameter, etc., described above are of course merely examples, and values appropriate to each device configuration may be determined as necessary.

Further, any combination may be made of the content of the embodiment above and each of the modifications.

<Summary>

The content of the embodiment and the modifications illustrates one aspect for solving the technical problems described under the heading "(2) Description of the related art", and a summary of the embodiment and the modifications is provided below.

The image forming device pertaining to the one aspect of the present invention is an image forming device comprising: a photoreceptor that is a rotatable body including a protective layer covering a photoreceptor layer, the protective layer being harder than the photoreceptor layer; a charger that charges the photoreceptor by using a physical contact process; and a metal cleaning blade that cleans a surface of the photoreceptor, an end of the cleaning blade contacting the surface of the photoreceptor and disposed facing in a direction counter to a direction of rotation of the photoreceptor, wherein the cleaning blade includes a first portion from the end of the cleaning blade to a position M that is a distance J from the end of the cleaning blade and a second portion that extends from the position M without overlapping the first portion, a surface of the first portion that faces the photoreceptor being a first region and a surface of the second portion that faces the photoreceptor being a second region, the first region is of a predefined roughness, and $J>h\times(\cos\alpha/\sin\beta)\times d$, where $\alpha$ is an angle between the first region and a tangent plane of the second region at the position M, $\beta$ is an angle between the first region and a tangent line of the surface of the photoreceptor at a point of contact with the cleaning blade, h is an amount of depletion of the cleaning blade in a direction perpendicular to the surface of the photoreceptor at the point of contact when the surface of the photoreceptor travels a unit of distance, and d is a predicted total travel distance of the surface of the photoreceptor in a defined time period.

Further, the image forming device may be configured so that $\beta<\gamma$, where $\gamma$ is an angle between the tangent line and a surface of the end of the cleaning blade.

Further, $\beta$ may have a value from 7° to 20°.

Further, $\beta$ may have a value from 10° to 15°.

Further, the protective layer may have a universal hardness (HU) value from 250 to 350.

Further, the photoreceptor layer may have a negative charge polarity.

Further, the protective layer may comprise a resin layer containing metal oxide particles.

The image forming device may further comprise: an exposer that exposes the photoreceptor to light, after charging, to form an electrostatic latent image on the photoreceptor; a developer unit that develops the electrostatic latent image to form a toner image; and a transfer unit that transfers the toner image onto a transfer target, wherein the cleaning blade cleans the surface of the photoreceptor after the toner image is transferred, the toner image includes toner particles and an external additive, and the predefined roughness is defined by a ten-point mean roughness Rz in the first region of the cleaning blade being greater than an average particle diameter of a portion of the external additive that is transferred from the developer unit and attached to the surface of the photoreceptor, and a local maximum height Ry in the first region of the cleaning blade being less than an average particle diameter of the toner particles.

Further, the ten-point mean roughness Rz and the local maximum height Ry may define surface roughness of the cleaning blade along a direction parallel to an axis of rotation of the photoreceptor.

Further, the predefined roughness may be achieved by using a grinding process, and the grinding process may be performed in a direction parallel to an axis of rotation of the photoreceptor.

Further, in a state in which the surface of the photoreceptor is in contact with the cleaning blade, rotary drive torque of the photoreceptor may be equal to or less than 0.1 N·m.

Further, the cleaning blade may be a leaf spring and the end of the cleaning blade may be pressed against the surface of the photoreceptor by a restoring force of the leaf spring.

According to the above, environmental burden can be reduced by adoption of the contact charging method, and product life of the photoreceptor can be increased by providing the photoreceptor with the protective layer that is harder than the photoreceptor layer. Further, discharge product attached to the surface of the photoreceptor can be scraped off by the end portion of the metal cleaning blade, without depending on elastic deformation of a rubber cleaning blade. Accordingly, even when using the metal cleaning blade, the photoreceptor is unlikely to be damaged due to the high hardness protective layer, and reliable cleaning can be maintained over a long time period.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

The invention claimed is:

1. An image forming device comprising:

a photoreceptor that is a rotatable body including a protective layer covering a photoreceptor layer, the protective layer being harder than the photoreceptor layer;

a charger that charges the photoreceptor by using a physical contact process; and a metal cleaning blade that cleans a surface of the photoreceptor, an end of the cleaning blade contacting the surface of the photoreceptor and disposed facing in a direction counter to a direction of rotation of the photoreceptor, wherein the cleaning blade includes a first portion from the end of the cleaning blade to a position M that is a distance J from the end of the cleaning blade and a second portion that extends from the position M without overlapping the first portion, a surface of the first portion that faces the photoreceptor being a first region and a surface of the second portion that faces the photoreceptor being a second region, the first region is of a predefined roughness, and $$J>h\times(\cos\alpha/\sin\beta)\times d$$

where $\alpha$ is an angle between the first region and a tangent plane of the second region at the position M, $\beta$ is an angle between the first region and a tangent line of the surface of the photoreceptor at a point of contact with the cleaning blade, h is an amount of depletion of the cleaning blade in a direction perpendicular to the surface of the photoreceptor at the point of contact when the surface of the photoreceptor travels a unit of distance, and d is a predicted total travel distance of the surface of the photoreceptor in a defined time period.

2. The image forming device of claim 1, wherein $$\beta<\gamma$$

where $\gamma$ is an angle between the tangent line and a surface of the end of the cleaning blade.

3. The image forming device of claim 1, wherein $\beta$ has a value from 7° to 20°.

4. The image forming device of claim 3, wherein $\beta$ has a value from 10° to 15°.

5. The image forming device of claim 1, wherein the protective layer has a universal hardness (HU) value from 250 to 350.

6. The image forming device of claim 1, wherein the photoreceptor layer has a negative charge polarity.

7. The image forming device of claim 1, wherein the protective layer comprises a resin layer containing metal oxide particles.

8. The image forming device of claim 1, further comprising:

an exposer that exposes the photoreceptor to light, after charging, to form an electrostatic latent image on the photoreceptor;

a developer unit that develops the electrostatic latent image to form a toner image; and a transfer unit that transfers the toner image onto a transfer target, wherein the cleaning blade cleans the surface of the photoreceptor after the toner image is transferred, the toner image includes toner particles and an external additive, and the predefined roughness is defined by a ten-point mean roughness Rz in the first region of the cleaning blade being greater than an average particle diameter of a portion of the external additive that is transferred from the developer unit and attached to the surface of the photoreceptor, and a local maximum height Ry in the first region of the cleaning blade being less than an average particle diameter of the toner particles.

9. The image forming device of claim 8, wherein the ten-point mean roughness Rz and the local maximum height Ry define surface roughness of the cleaning blade along a direction parallel to an axis of rotation of the photoreceptor.

10. The image forming device of claim 8, wherein the predefined roughness is achieved by using a grinding process, and the grinding process is performed in a direction parallel to an axis of rotation of the photoreceptor.

11. The image forming device of claim 1, wherein in a state in which the surface of the photoreceptor is in contact with the cleaning blade, rotary drive torque of the photoreceptor is equal to or less than 0.1 N·m.

12. The image forming device of claim 1, wherein the cleaning blade is a leaf spring and the end of the cleaning blade is pressed against the surface of the photoreceptor by a restoring force of the leaf spring.

* * * * *